US005252777A

United States Patent [19]

Allen

[11] Patent Number: 5,252,777

[45] Date of Patent: Oct. 12, 1993

[54] ELECTRIC GUITAR WITH TRANSDUCER CRADLES

[75] Inventor: Michael J. Allen, 161 Woodlawn Rd., Burlington, Vt. 05401

[73] Assignees: Michael J. Allen; June E. Casazza, Burlington, Vt.

[21] Appl. No.: 926,272

[22] Filed: Aug. 10, 1992

[51] Int. Cl.[5] ..... G10H 3/18; G10H 3/00; G10H 1/32

[52] U.S. Cl. ..... 84/726; 84/743

[58] Field of Search ..... 84/723, 726, 743, 727

[56] References Cited

U.S. PATENT DOCUMENTS

| | | | |
|---|---|---|---|
| 3,869,952 | 3/1975 | Rowe | 84/727 |
| 3,911,777 | 10/1975 | Rendell | 84/743 |
| 4,142,435 | 3/1979 | Pozar | 84/743 |
| 4,184,399 | 1/1980 | Zuniga | 84/727 |
| 4,254,683 | 3/1981 | Nulman | 84/727 |
| 4,425,831 | 1/1984 | Lipman | 84/743 |
| 4,433,603 | 2/1984 | Siminoff | 84/726 |
| 4,535,668 | 8/1985 | Schaller | 84/727 |
| 4,686,881 | 8/1987 | Fender | 84/727 |
| 4,854,210 | 8/1989 | Palazzolo | 84/743 |
| 4,872,386 | 10/1989 | Betticare | 84/726 |
| 5,029,511 | 7/1991 | Rosendahl | 84/743 |

*Primary Examiner*—William M. Shoop, Jr.
*Assistant Examiner*—Jeffrey W. Donels
*Attorney, Agent, or Firm*—John J. Welch

[57] ABSTRACT

The instant invention encompasses the combination of a modified electric guitar component coupled with a plurality of equivalent one-coil and equivalent two-coil transducer cradle components attached thereto upon which cradles, transducers are permanently mounted respectively. The transducer cradle components are readily amenable to detachment from and reattachment to the body of the electric guitar component and as well to speedy frontwise insertion into or frontwise removal from the modification of the electric guitar component, to wit, appropriately contoured openings in the front of the body of the electric guitar component below the level of intact guitar strings. Metallic contact rods on each cradle component receive transducer wiring emanating from a permanently mounted transducer and contact, upon insertion of a given cradle into a given opening, by way of contact points in the front wall of the opening, the internal wiring within the modified electric guitar component and ultimately, an amplifier.

13 Claims, 4 Drawing Sheets

ELECTRIC GUITAR WITH TRANSDUCER CRADLES

CROSS REFERENCES TO PRIOR APPLICATIONS

There are no prior or pending applications related to this application.

FEDERALLY SPONSORED RESEARCH AND DEVELOPMENT

There is no involvement with any federally sponsored research and development.

BACKGROUND OF THE INVENTION

1. Field of the Invention:

The instant invention relates to the art of electric guitars with a plurality of readily removable pickups (one coil transducers) and humbuckers (two coil transducers) mounted on cradles serving to facilitate quick and convenient removal of such pickup or humbucker devices from such guitars appropriately modified to accommodate their frontwise insertion into and removal from openings in the bodies of such guitars below the level of intact strings. The instant invention facilitates such quick and ready removal of such transducers from the front of the body of any such modified guitar without first requiring removal of such a guitar's strings or desoldering and resoldering of such any of guitar's internal wiring components.

2. Possible Prior Art:

The following patents may bear somewhat on the essence of the instant invention. However, the instant invention represents a manifest improvement upon and variation from any other arguably similar devices currently in or of vogue in any guitar related musical field.

| Inventor | Invention | Patent No. | Date |
|---|---|---|---|
| 1. Fender | Electromagnetic Pickup For Stringed Musical Instruments | 4,686,881 | 8/18/87 |
| 2. Zuniga | Magnetic Pickup Assembly | 4,184,399 | 1/22/80 |
| 3. Rowe | Pickup Mount for Stringed Musical Instruments | 3,869,952 | 3/11/75 |
| 4. Lipman | Electric Guitar Transducer Mount | 4,425,831 | 1/17/84 |
| 5. Schaller | Magnetic Pickup for Stringed Instruments | 4,535,668 | 8/20/85 |
| 6. Pozar | Pickup Assembly for Stringed Instrument | 4,142,435 | 3/6/79 |
| 7. Siminoff | Component Musical Instrument | 4,433,603 | 2/28/84 |
| 8. Betticare | Interchangeable Pick-up for Electric Guitar | 4,872,386 | 10/10/89 |
| 9. Nulman | Stringed Electrical Instrument | 4,254,683 | 3/10/81 |
| 10. Rendell | Electric Guitar with Slidable Pickup Beneath Strings | 3,911,777 | 10/14/75 |

An article at page 10 of the Autumn, 1990 edition of "Guitar Player" refers to a pickguard assembly with insertable custom wound single coil pickups that however does not appear to relate to the instant invention.

SUMMARY OF THE INVENTION

1. A Description of the Invention:

The instant invention consists of an electric guitar with attached but readily detachable transducer cradles upon which transducers are mounted which are meant to be individually inserted frontwise into various appropriately hollowed out openings in the electric guitar's body thereby facilitating quick and ready interchanging and replacement of such transducers so mounted on such cradles from and into any such so appropriately modified electric guitar. An electric guitar of any desired contour is formed with on or more openings below the level of intact guitar strings extending from the front face of the guitar's body into the guitar's body but not extending all the way through the guitar's body to the back side of the guitar's body. Each opening is appropriately dimensioned so as to accommodate receipt of any one of the transducer cradle components of the invention below the level of the intact strings of the guitar component through the front of the guitar's body. Each such opening has a floor and two lateral walls within the electric guitar body. The posterior wall of each is inclined and the front walls of each has contact points that are in contact with the guitar's internal wiring. Each transducer cradle component of the invention consists of a four edged five hole top plate. The front edge of this top plate of each of the cradle components of the invention is perpendicular to the top plate's two lateral edges. The back edge of each cradle's top plate is slightly curved such that the lateral edge of the top plate that is closest to the bottom contour of the guitar body upon frontwise insertion of one of the cradle components of the invention into the modified guitar body component of the invention is slightly shorter in length than its counterpart. In this manner, the top plate of each of the cradles with a round grasping hole centrally positioned in its longest midline much closer to its back edge than its front edge which grasping hole is large enough to receive a person's index finger for purposes of inserting it or removing it readily into or from the opening in the guitar component's body, is readily able to accommodate geometrically any conventional modified pickguard as may be optionally placed above it below the level of the guitar component's strings which pickguard would have within it as well a round hole of the same circumference as this grasping hole. Also within this top plate are to be found two small screw holes aligned with the center line of the round grasping hole centered as well on the longest midline of the top plate. These holes serve to receive two screws serving to mount on each of the cradle components; through a rectangularly shaped receiving hole the longest axis of which is likewise located in the top plates longest midline which receiving hole is located within each cradle's top plate between the two small screw holes; a transducer fitted with wiring and a dress plate with a rectangularly shaped hole in it that fits about the upper portions of a mounted transducer. Affixed to the bottom surface of the top plate of each cradle component are two side plates. These two side plates each consist of a front edge fastened to the bottom surface of the top plate such that the front edges of each are to be found close to the front edge of the top plate and perpendicular to it. These two side plates likewise consist of top edges and bottom edges parallel to one another and respectively perpendicular to the front edges of such side plates. The top edges of each side plate are of equal length and are longer than the bottom edges of the side plates that are likewise of equal length. Each side plate's top edge is suitably and permanently fastened to the bottom surface of each cradle's top plate close to the lateral edges of the top plate. The back edge of each side plate is inclined with negative slope from the back of each side plate's top edge to the back of each side plate's bottom edge. It is this inclination that readily facilitates frontwise insertion and removal of the cradle into and from one of the openings in the front face of an appropriately modified electric guitar's body below the level of its intact strings. There are two one piece metallic staple contact rods with holes in the back portions of each that are permanently fitted about the front edge of one of each cradle's side plates and two such rods with holes in the back portions of each that are permanently fitted about the front edge of each cradle's other side plate. On each of each cradle's side plates, these contact rods are permanently fastened two to a plate such that one rod is parallel to the top edge of the side plate and spaced apart from the other that is parallel to it and to the bottom edge of the side plate. The rods extend back along the side plates perpendicular to the front edges of the side plates. The portions of the rods that are fitted about the front edges of the side plates of each cradle serve to contact the contact points in the front wall of a guitar body opening that are in contact with the internal wiring and internal electronics within the modified guitar's body and the holes in the back portions of each such rod serve to receive wiring from each cradle's transducer mounted as noted above thereby effectuating direct conducting circuit between the wiring of a mounted transducer and the internal wiring and internal electronics within the modified electric guitar body and ultimately an amplifier. Finally, it should be noted that some transducers; one coil pickups and others; two coil humbuckers may need to be wired to either two, three or four of such rods. But, either two or three rod contact with a modified guitar body's internal wiring or four rod contact with a modified guitar's body's internal wiring will produce viable results from a vantage point of transducer function depending upon the type of transducer so mounted on any given cradle.

Finally, a fifth hole in the top plate of each cradle likewise aligned in the midline of each cradle with the other holes in the top plate of each cradle is located proximate to the posterior edge of the top plate of each cradle behind the grasping hole in the top plate of each. This hole serves to receive a small hook attached to a piece of threadwiring attached in turn by way of another small hook to a hookhold affixed to the outer surface of the body of the modified electric guitar component of the invention. This threadwire is readily removable from its attachment to the electric guitar component. Before guitar playing begins each piece of such threadwiring suitably attached to the electric guitar component is removed therefrom. Each cradle with a transducer mounted thereupon is, in turn, unhooked from each piece of such threadwiring. One or more of such transducer cradles is inserted frontwise into one or more respectively of the guitar body openings. The other cradles are simply pocketed by the guitarist along with the pieces of wiring. Playing begins and transducer cradles are then interchanged or not at a guitarist's pleasure. After guitar playing has been completed, each cradle is rehooked to its corresponding piece of threadwiring and each piece of threadwiring is in turn reattached to the outer surface of the body of the electric guitar component.

In essence, then, a guitarist utilizing this invention will be in possession of a plurality of cradle components each holding a different mounted transducer each of which is capable of effectuating its own unique sound modification that can each be readily and quickly inserted and removed frontwise from an appropriately modified guitar's body at will.

2. The Object of the Invention:

Different pickups and humbuckers produce different sound effects in electrical guitars. Consequently, it is very often desirable to employ various types of pickups and/or humbuckers in order to achieve desired varied musical effects. But, with conventional electric guitars, humbuckers or pickups are more or less permanently mounted within them beneath the guitar strings. Hence, interchange of such devices within such guitars requires that a guitar's strings first be removed and that secondly, wiring connecting such devices to internal guitar electronics be desoldered followed by a resoldering of the wiring from different humbuckers or pickups to internal wiring and electronics of such guitars followed by replacement of the guitar's strings. Such undertakings are very time consuming. As a practical matter, replacement, for instance, during the live performance of a musical concert simply could never take place.

The instant invention is eminently useful, since, use of its permits quick and ready humbucker and pickup interchanges merely within seconds thereby vastly enhancing the repertoire of a guitar player performing live in concert.

The instant invention is moreover novel and unique, and a vast improvement over other such instrument as have been fashioned to accomplish the end of such quick, ready and convenient humbucker or pickup interchanges. Some conventional instruments, for instance, allow for introduction of humbucker or pickup units held in a mounting sleeve through the rear side of an electronic guitar body. However the rear portions of most contemporary electric guitars are fitted with so-called tremolo springs to facilitate note wagging by way of guitar bridge flexing by musicians who appropriately manipulate bridges affixed to such guitars that are connected to such springs. The whole objective of accomplishing quick, ready and convenient interchanges would be completely defeated if tremolo spring and bridge disassembly and reassembly were required prior to and after such interchanges. On the other hand, with the instant invention, there is absolutely nothing required of the musician who would be seeking to effect such an interchange other than to simply remove the humbucker or pick up transducer cradle from the hollowed out opening in the front of the guitar's body and quickly replace it with another humbucker or pickup cradle holding a difference pickup or humbucker. Interference with tremolo springs thus becomes an irrelevant consideration.

Indeed, respectfully submitted, the instant invention is a truly revolutionary innovation that serves to radically enhance a guitar player's musical repertoire.

A BRIEF DESCRIPTION OF THE DRAWINGS

Figure 11:
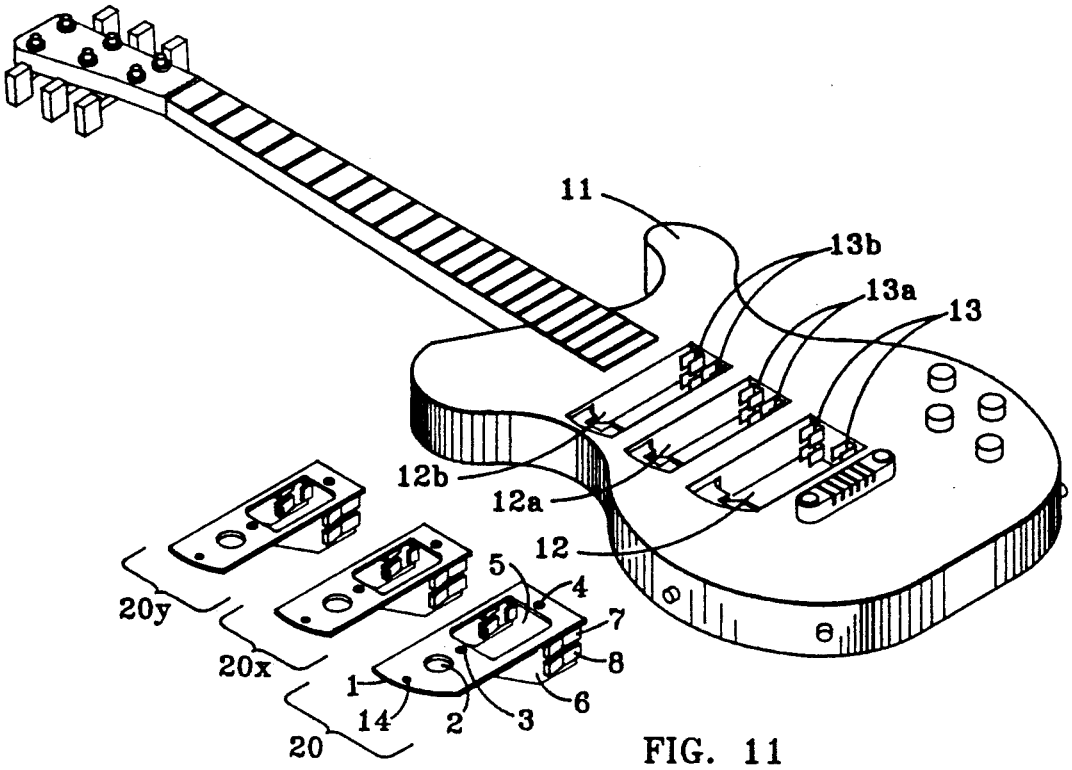

FIG. 11 is a top perspective view of the invention's appropriately modified electric guitar component likewise shown with the strings of the guitar removed. One of the transducer cradle components of the invention is shown in apposition to an opening through the front face of the guitar's body which opening is shown dimensioned so as to properly and appropriately receive the transducer cradle component so therein shown.

Figure 12:
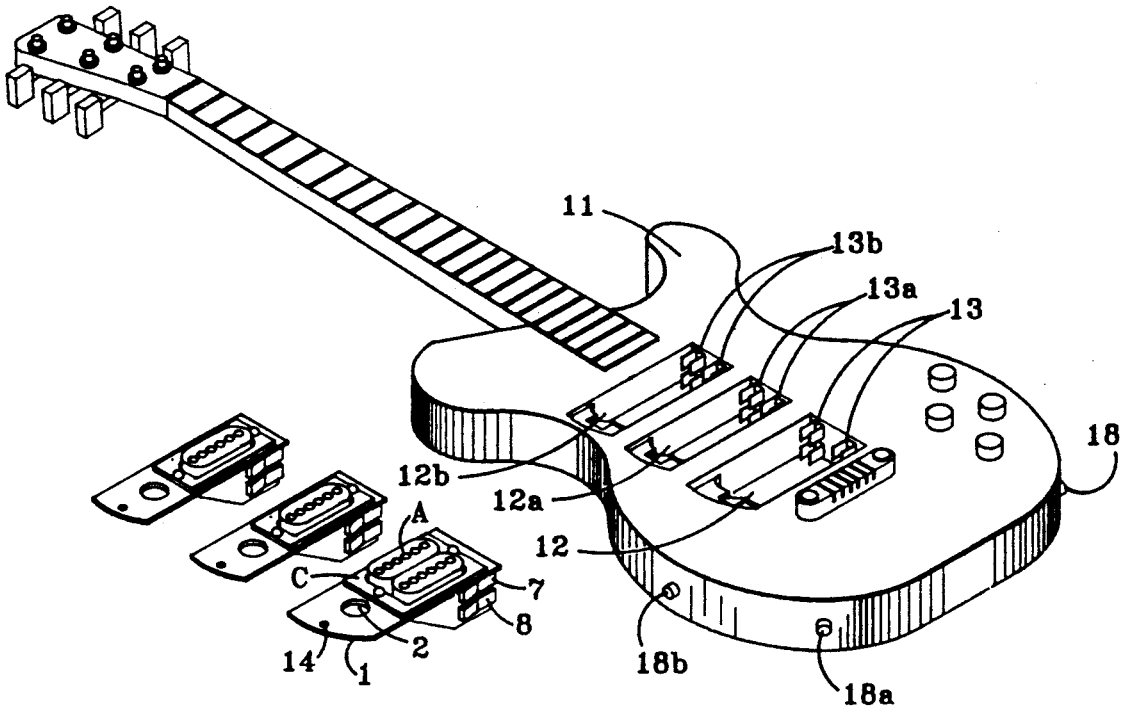

FIG. 12 is a top perspective view of the invention's appropriately modified electric guitar component likewise shown with the strings of the guitar removed. One of the invention's transducer components complete with a mounted transducer circumscribed by a dress plate is shown in apposition to an opening through the front face of the guitar's body which opening is shown dimensioned so as to properly and appropriately receive the invention.

Figure 13:
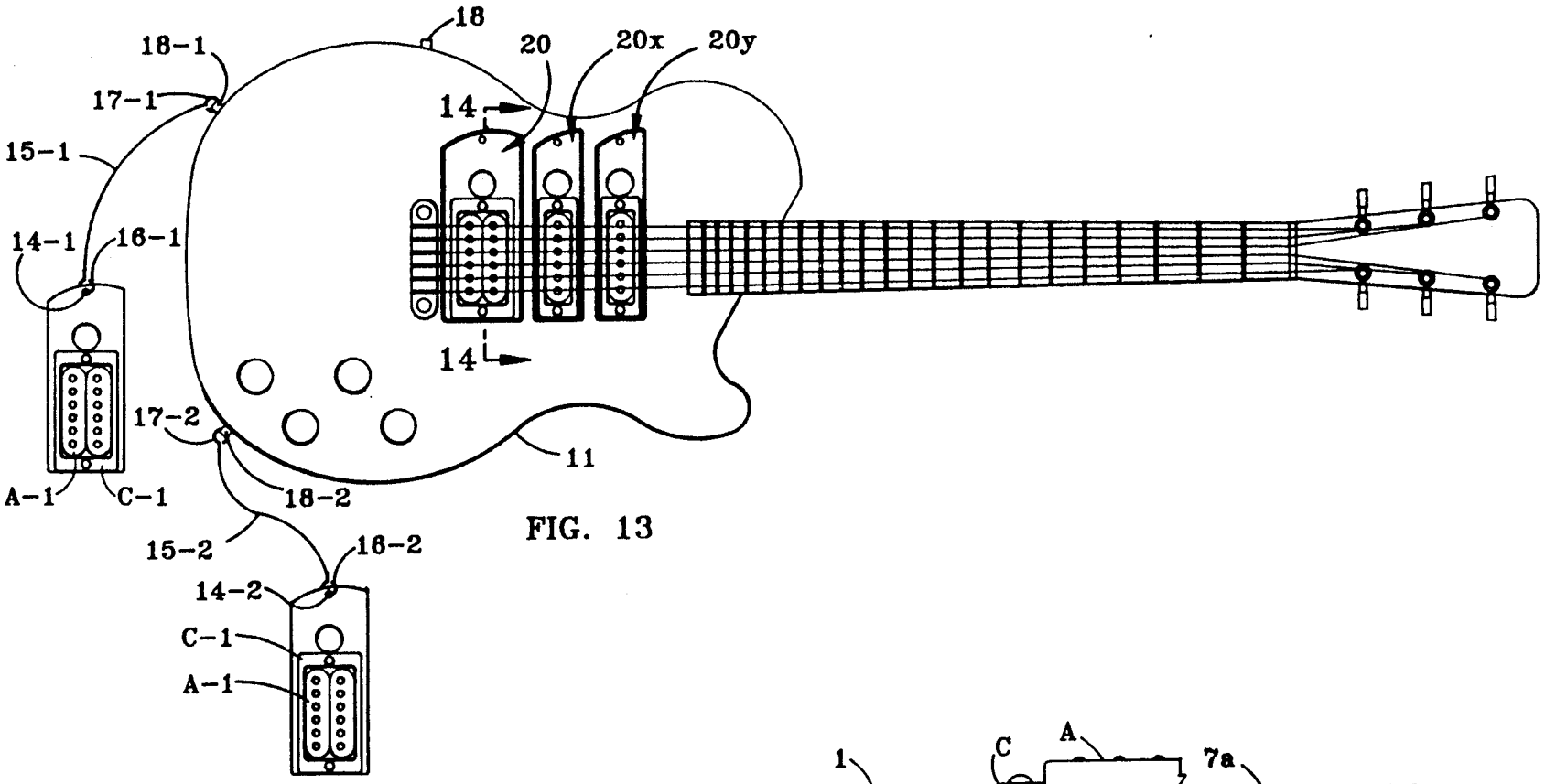

FIG. 13 is a top plan view of the invention's appropriately modified electric guitar component shown with its strings intact below which each one of the transducer cradle components of the invention with mounted transducers circumscribed by dress plates have been inserted into the openings through the front face of the guitar's body. Also, shown are two more transducer components with mounted transducers circumscribed by dress plate affixed to a hook on one end of a wire in turn affixed by a hook on the other end of the wire to a hookhold of the body of the electric guitar component of the invention.

Figure 14:
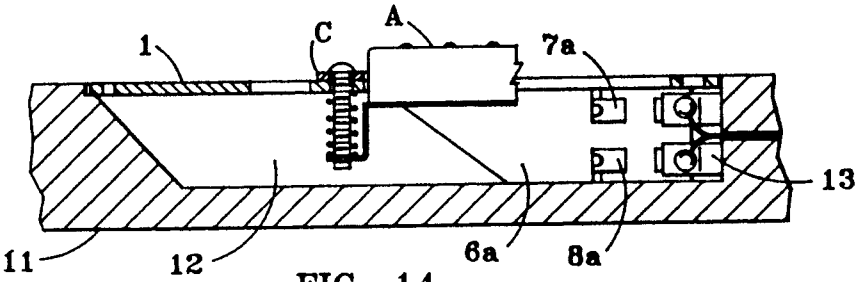

FIG. 14 is a cross-sectional view through one of the openings in the body of the electric guitar component of the invention showing how the contact rods of a transducer cradle come into contact with contact points in the opening that lead to the guitar component's internal wiring.

A DESCRIPTION OF THE PREFERRED EMBODIMENT

Figure 1:
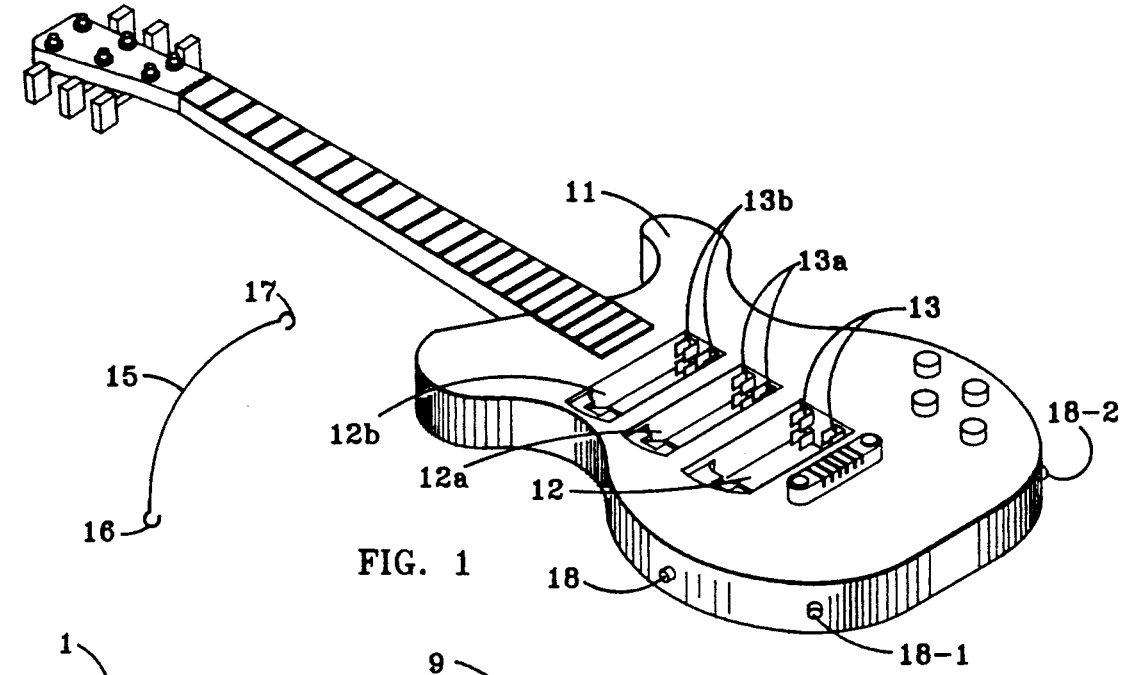
FIG. 1 is a top plan view of the appropriately modified electric guitar component of the invention. The strings of the guitar have been removed to illustrate a plurality of openings through the front face of the guitar's body into which one or more of the invention's equivalent transducer cradle components is inserted.
Figure 2:
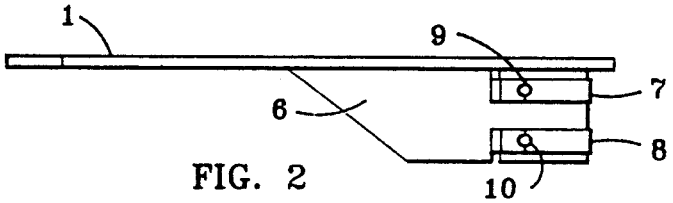
FIG. 2 is a lateral view of one of the equivalent transducer cradle components of the invention.
Figure 3:
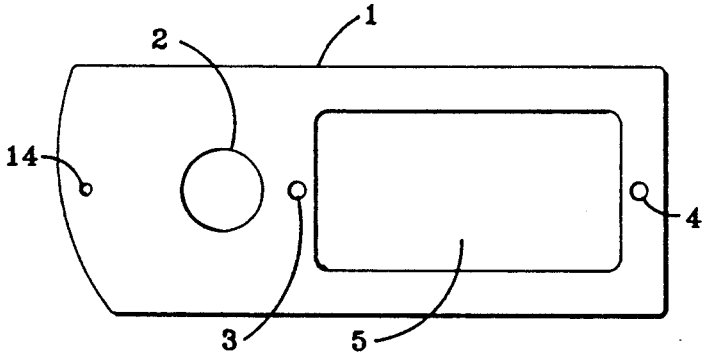
FIG. 3 is a top plan view of one of the equivalent transducer cradle components of the invention.
Figure 4:
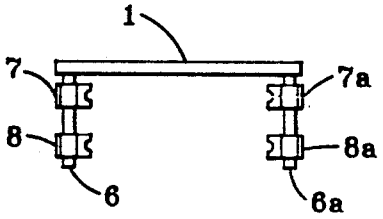
FIG. 4 is a frontal view of one of the equivalent transducer cradle components of the invention.
Figure 5:
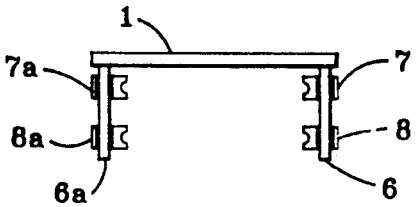
FIG. 5 is a posterior view of one of the equivalent transducer cradle components of the invention.

FIG. 1, shows in top plan view, a stringless guitar component 11 with an arbitrarily contoured body into which openings 12, 12*a* and 12*b* has been hollowed out. Opening 12 is contoured and shaped so as to receive one of the instant invention's plurality of two-coil transducer cradle components, to wit, 20 said one of which is shown in lateral view in FIG. 2 and in top plan view in FIG. 3. Opening 12 could have just as easily been contoured and shaped to receive any one of the instant invention's plurality of one-coil transducer cradle component, to wit, 20*x* or 20*y* as seen in FIG. 11 and FIG. 12 as well as in FIG. 13. All cradles are of the same shape and design. All of them have exactly the same component parts. But, the one-coil cradles are slightly thinner in width than the two-coil ones, since, one-coil pickups are thinner than two-coil pickups. Opening 12 as shown in FIG. 1 does not extend through the whole of the breadth of the body of guitar component 11. Neither do openings, 12*a* and 12*b*. Lateral side plate 6, is one of the two side plates of the exemplar transducer cradle component, 20 shown in FIG. 2 and is affixed permanently to top plate 1 of the transducer cradle component which top plate 1 is depicted in top view in FIG. 3. As can be seen from FIG. 2, the top edge of lateral side plate 6 is parallel to but shorter in length than its bottom edge. The back edge of lateral side plate 6 is negatively sloped to facilitate ready insertion into and removal from opening 12 of this or any of the invention's other equivalent, in this example, two-coil transducer cradle components. Also shown in FIG. 2 are metallic staple contact rods 7 and 8. These rods are permanently affixed to lateral side plate 6. The anteriormost portions of these rods curl about and abut the front edge of lateral side plate 6 which front edge is perpendicular to the top and bottom edges of lateral side plate 6. The anteriormost portions of these rods serve to make contact with internal wiring and electronics housed within the body of electric guitar component 11 via contact points 13, 13*a* or 13*b* in the front wall of opening 12 or 12*a* or 12*b* when this or any one of the invention's equivalent transducer cradles is inserted into opening 12. FIGS. 4 and 5 show lateral side plate 6 and rods 7 and 8 in frontal and posterior views respectively. These figures also show the counterparts of these components, namely lateral side plate 6*a* and metallic staple contact rods 7*a* and 8*a*. At this juncture it should be noted once again that the single coil transducer cradle components of the invention are of the same shape and with the exact same parts and characteristics as the two coil ones depicted in FIGS. 2, 3, 4 and 5, 8 and 10. The single coil cradle components as seen in FIG. 11 and FIG. 12 and within guitar component, 11 in FIG. 13 differ from the double coil ones only in that they're thinner in terms of width than their double coil counterparts.

It should be noted here that each of openings 12, 12*a* and 12*b* leads into a compartment that has a floor and two lateral walls within the electric guitar body component 11. The compartment of each has an inclined posterior wall to effectuate ready receipt and removal frontwise of a transducer cradle. The front wall of each's compartment is fitted with a plurality of contact points 13. 13*a* and 13*b* that are metallic and connected to the internal wiring within electric guitar body component 11. It is, once again, by way of contact between the contact rods 7, 7*a*, 8 and 8*a* of FIGS. 2, 4 and 5 and these contact points 13 as seen in FIG. 1 regarding opening 12 when any one of the invention's equivalent two-coil transducer cradles with a two-coil transducer thereupon permanently mounted is inserted into opening 12 that electrical connection as between the mounted transducer and an electric guitar amplifier by way of guitar internal wiring is accomplished so as to thereby actuate desired sound variabilities. The same exact mechanism applies as respects insertion of any one of the invention's equivalent single coil cradles with a single coil transducer permanently mounted thereupon into openings 12*b* or 12*c*.

Figure 6:
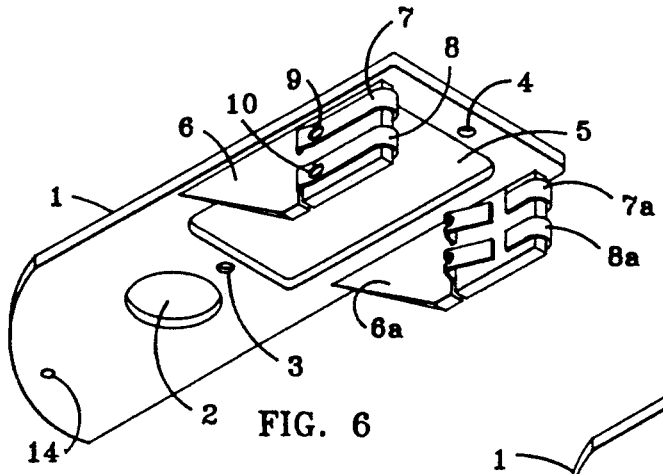
FIG. 6 is a bottom perspective view of one of the equivalent transducer cradle components of the invention.
Figure 7:
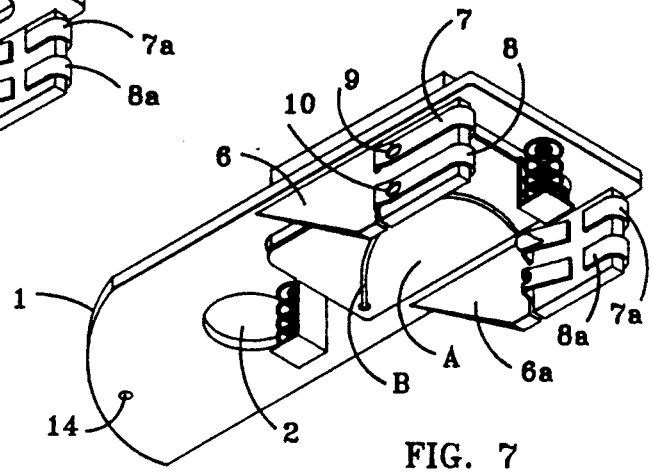
FIG. 7 is a bottom perspective view of one of the equivalent transducer cradle components of the invention shown with a transducer mounted to it and transducer wiring connected to the posterior portions of the cradle's contact rods.
Figure 8:
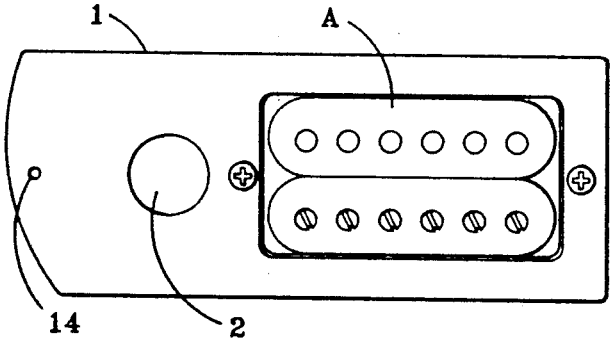
FIG. 8 is a top plan view of one of the equivalent transducer cradle components of the invention shown with a transducer mounted to it.
Figure 9:
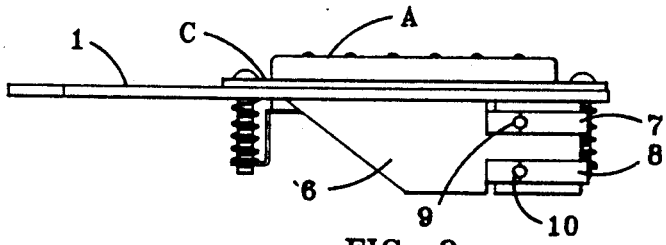
FIG. 9 is a lateral view of one of the equivalent transducer cradle components of the invention shown with a transducer mounted to it and circumscribed by a dress plate.
Figure 10:
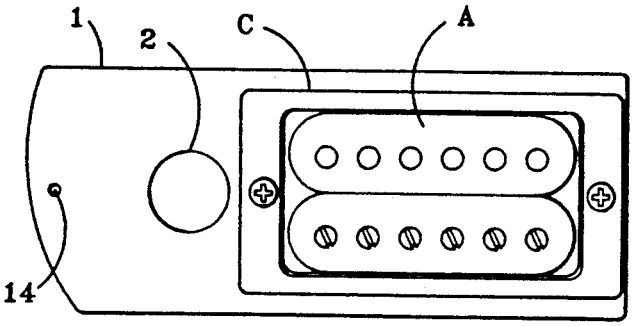
FIG. 10 is a top plan view of one of the equivalent transducer cradle components of the invention shown with a transducer mounted to it and circumscribed by a dress plate.

FIG. 2 also shows holes 9 and 10 in rods 7 and 8 respectively. The counterparts of these holes namely holes 9*a* and 10*a* can be seen in FIG. 6, a bottom perspective view of one of the equivalent two-coil transducer cradles of the invention. Holes 9 and 10 and 9*a* and 10*a* serve to receive wiring B from a transducer A as shown in FIG. 7 which is a bottom perspective view of the instant one of the invention's equivalent transducer cradle components shown with a transducer A thereupon mounted. Holes 9, 10, 9*a* and 10*a* via rods 7, 8, 7*a* and 8*a* facilitate direct contact between wiring B of a permanently mounted transducer A and the internal wiring and electronics housed within the electric guitar component body 11, as just noted, via contact points 13 when one of the invention's equivalent two-coil cradle components with a transducer A permanently mounted thereupon is placed into opening 12. FIG. 3, a top plan view of the instant one of the equivalent two-coil transducer cradle components of the invention shows as noted above, its four edge-five hole top plate 1. Securing hole 14 is therein shown proximate to the curvilinear back edge of four edge-five hole top plate 1. Grasping hole 2 therein also shown has a circumference the size of a person's index finger to readily facilitate grasping the cradle for purposes of removing it from or inserting it into opening 12. Grasping hole 2 is much closer to the curvilinear back edge of four edge-five hole top plate 1 than to its straight front edge which front edge is in turn perpendicular to its two parallel lateral edges the one of which parallel edges closest to the bottom of electric guitar component 11 during insertion of the transducer cradle component of the invention into opening 12 is shorter than its counterpart. The curvilinear shape of the back edge of four edged-five hole top plate 1 and the discrepancy in length of its two lateral edges serve collectively to facilitate geometric accommodation of top plate 1 to the shape of a conventional guitar pickguard. Securing hole 14 and grasping hole 2 are centered on the longest midline of top plate 1 as are screw holes 3 and 4 and as is likewise the longest axis of rectangular receiving hole 5 situate in top plate 1 symmetrically between screw holes 3 and 4 all of which are shown in FIG. 3. Screw holes 3 and 4 serve to receive screws through them which screws operate to mount to top plate 1 a transducer A through rectangular receiving hole 5 all as shown in FIGS. 3, 7, 8 and 10 respectively. FIG. 9 is a lateral view of one of the equivalent transducer cradle components of the invention shown with a transducer A mounted to it and circumscribed by a dress plate C. FIG. 11 is a top perspective view of electric guitar component 11 with its strings removed. The body of electric guitar component 11 therein shown contains opening 12 contoured and shaped to receive one of the equivalent two-coil transducer cradle components of the invention which is also therein shown. FIG. 12 is a top perspective view of electric guitar component 11 therein shown with opening 12 contoured and shaped to receive one, to wit, 20 of the equivalent two-coil transducer cradle components of the invention with a two-coil transducer A mounted thereupon and further shown circumscribed by a dress plate C all therein shown in proximity to opening 12. Openings 12*b* and 12*c* contoured to receive equivalent one-coil transducer cradles along with such cradles, to wit, 20*x* and 20*y* with mounted one-coil transducers are also therein shown. Also, FIG. 13 shows a plurality of equivalent transducer cradle components of the invention holding mounted transducers A-1 and A-2 circumscribed by dress plates C-1 and C-2 as are held by way of securing hooks 16-1 and 16-2 on threadwiring 15-1 and 15-2 to securing holes 14-1 and 14-2 of the respective four edge-five hole top plates of such transducer cradle components. Threadwiring 15-1 and 15-2 are in turn attached to the body of electric guitar component by way of attachment hooks 17-1 and 17-2 on the ends of such threadwiring 15-1 and 15-2 opposite to the ends to which are appended securing hooks 16-1 and 16-2. Also therein shown are small hookholds 18-1 and 18-2 permanently affixed to the body of electric guitar component 11. Hookhold 18 for attachment of attachment hook 17 on threadwire 15 as seen in FIG. 9 is also shown. Moreover, wire 15, for use with the transducer cradle component shown in FIG. 13 as being actually within opening 12, when that transducer cradle component is ultimately removed from opening 12, is shown in FIG. 1 as being separated from hookhold 18. Also, two-coil transducer cradle, 20 is therein shown with a two-coil transducer thereupon mounted and is therein shown already placed into opening 12 of guitar component 11, and one-coil transducer cradles, 20*x* and 20*y* are therein shown with one-coil transducers thereupon mounted and are therein shown already placed in openings 12*b* and 12*c* of guitar component, 11. Finally, FIG. 14 is a cross-sectional view through one of the openings in the body of the electric guitar component, 11 of the invention showing how the contact rods of a transducer cradle come into contact with contact points in the opening that lead to the guitar component's internal wiring.

When any one of the equivalent transducer cradle components of the invention with its mounted transducer is in use during a performance by a musician using the invention by way of its insertion into opening 12, or 12*a* or 12*b* as the case may be then, its corresponding threadwiring, for example, threadwiring 15 or 15-1 or 15-2, as the case may be, etc., is separated from hookhold 18 or 18-1 or 18-2 as the case may be and put into a guitar player's pocket. Also, when the invention is being so used, the invention's other equivalent transducer cradle components with double coil or single coil transducers mounted thereupon as the case may be and threadwiring, i.e. threadwiring 15-1 and 15-2 are likewise easily disassembled from hookholds 18-1 and 18-2 and likewise pocketed by the guitarist. A further embodiment of the invention encompasses the means by which transducer cradle components with mounted transducers not in use at any given moment and not inserted into openings 12 or 12*a* or 12*b* are held fast to the body of the electric guitar component 11. The non-inserted transducer cradle components are held within appropriately contoured sleeves on the bottom of which there are to be found suitable adhesive strips fastened thereto which said strips are held fast to suitable strips located on the body of electric guitar component 11. A further embodiment contemplates tracks on the bottom of such sleeves in lieu of adhesive strips that slide into trackholders permanently fastened to the body of electric guitar component 11.

In closing, the above given disclosure has been proffered by way of illustration and clarification of the best mode of the invention. It should not be deemed however to serve to limit the embodiment of the invention. It is desired to preserve all embodiments of the invention as comprehended to be within the scope of the ensuing claims.

I claim:

1. A method for rapidly and readily frontwise inserting and/or removing an electric guitar single coil transducer directly from an opening in the front of the body of an electric guitar component below the level of intact guitar strings and for coupling said single coil transducer to internal electrical wiring within said electric guitar body and in turn to an amplifier; comprising the steps of: forming an opening in the body of said electric guitar extending from the front of said body and partially into said body; but not through to the back of said body; and, providing for connection between the wiring of said single coil transducer individually and permanently mounted on a single coil transducer cradle component to the internal electrical wiring within said electric guitar component, by way of contact rods on said single coil transducer cradle component when said single coil transducer cradle component is inserted into said opening which said contact rods are then simultaneously in contact with the wiring of said single coil transducer and contact points in the front wall of said opening that in turn contact said internal electrical wiring.

2. The method of claim 1 in which said opening is appropriately contoured to receive one single coil transducer cradle component with a single-coil transducer permanently mounted thereupon.

3. The method of claim 1 in which said opening is appropriately contoured to receive one single coil transducer cradle component with a single-coil transducer permanently mounted thereupon but with a clearance therebetween.

4. An electric guitar with readily attachable and detachable transducer cradles, comprising:

a. a plurality of equivalent double coil transducer cradle components of equal configuration, shape and size upon each of which respectively one double coil transducer is permanently mounted.

b. a plurality of equivalent single coil transducer cradle components of equal configuration, shape and size upon each of which respectively one single coil transducer is permanently mounted.

c. an electric guitar component having guitar strings and internal wiring for coupling a single coil transducer mounted on one of said equivalent single coil transducer cradle components adjacent said guitar strings to an amplifier and for coupling a double coil transducer mounted on one of said equivalent double coil transducer cradle components adjacent said guitar strings to an amplifier and having a guitar body defining the outer contours of said electric guitar component with said guitar strings anchored to said guitar body and having a first set of equivalently dimensioned openings in said guitar body all appropriately contoured to readily frontwise receive any one of said equivalent single coil transducer cradle components with a mounted single coil transducer and having another opening, to wit, a larger opening in said guitar body, different in dimension from the openings in said first set of equivalently dimensioned openings, appropriately contoured to readily frontwise receive any one of said equivalent double coil transducer cradle components with a mounted double coil transducer all of which said openings in said first set of equivalently dimensioned openings and which said larger opening all extend from the front of said guitar body and into but not through the back of said guitar body.

d. contact points in the front walls of all said openings in said first set of equivalently dimensioned openings as are in contact with said internal wiring all of which said openings in said first set of equivalently dimensioned openings each have, as well, also two lateral walls and a floor;

e. contact points in the front wall of said larger opening as are in contact with said internal wiring which said larger opening has, as well, also two lateral walls and a floor;

f. contact rods affixed to each of said equivalent single coil transducer cradle components which said contact rods are coupled with the wiring of each of the transducers thereupon respectively mounted and which said contact rods of whichever of said equivalent single coil transducer cradle components as are inserted frontwise into whichever of said openings of said first set of equivalently dimensioned openings below the level of intact guitar strings are, upon such insertion, in contact with said contact points;

g. contact rods affixed to each of said equivalent double coil transducer cradle components which said contact rods are coupled with the wiring of each of the transducers thereupon respectively mounted and which said contact rods of whichever of said equivalent double coil transducer cradle components as are inserted frontwise into said larger opening below the level of intact guitar strings are, upon such insertion, in contact with said contact points;

h. means for readily attaching and detaching said equivalent single coil transducer cradle components upon which single coil transducers are permanently mounted to and from hookholds affixed to the outer surface of said guitar body;

i. means for readily attaching and detaching said equivalent double coil transducer cradle components upon which double coil transducers are permanently mounted to and from hookholds affixed to the outer surface of said guitar body.

5. The electric guitar with transducer cradle components of claim 4 in which all said attaching and detaching means of parts h and i of claim 4 are pieces of threadwire with a hook at each end of each one of said pieces of threadwire.

6. The electric guitar with readily attachable and detachable transducer cradles of claim 4, in which each said equivalent double coil transducer cradle component is made up of:

a. a four edged, five hole top plate with a straight front edge, a first lateral edge and a second lateral edge parallel to each other with each said lateral edge perpendicular to said front edge and further a curved posterior edge with a small hook securing hole centered on said top plate's longest midline proximate to said curved posterior edge, a first round grasping hole of diameter in excess of three-eighths of an inch also centered on said top plate's longest midline but less proximate to said curved posterior edge than said small hook securing hole, a first round screw hole for receipt of a transducer mounting screw located in said top plate's longest midline anterior to said first round grasping hole, a rectangular hole for receipt of a mounted transducer, the longest midline of which said rectangular hole so located on said top plate, and a second round screw hole for receipt of a transducer mounting screw which said second round screw hole is located centered in said top plate's longest midline anterior to said rectangular hole;

b. a first four edged lateral side plate with top and bottom edges parallel to one another and perpendicular to said side plate's front edge and with a posterior edge inclined with negative slope which said side plate is permanently joined at its top edge to the bottom surface of said four edged, five hole top plate proximate to the said first lateral edge of said four edge, five hole top plate;

c. a second four edged lateral side plate shaped exactly like said first four edged lateral side plate and permanently joined at its top edge to the bottom surface of said four edged, five hole top plate proximate to the said second lateral edge of said four edge, five hole top plate in a position plan parallel to the positional plane of said first four edged lateral side plate when said side plates are so permanently joined to said four edge, four hole top plate;

d. a first pair of two equivalent metallic contact staple rods each permanently affixed about the front edge of said first four edged lateral side plate and each permanently affixed to the inner and outer surfaces of said first four edged lateral side plate and each with one small hole in the end of each which end is furthest from said front edge and most proximate to said inner surface and such that each one of said metallic contact staple rods is separated from the other and so permanently affixed in positional planes parallel to each other and parallel to the top and bottom edges of said first four edged lateral side plate;

e. a second pair of two equivalent metallic contact staple rods each permanently affixed about the front edge of said second four edged lateral side plate and each permanently affixed to the inner and outer surfaces of said second four edged lateral side plate and each with one small hole in the end of each which end is furthest from said front edge and most proximate to said inner surface and such that each one of said metallic contact staple rods is separated from the other and permanently affixed in positional planes parallel to each other and parallel to the top and bottom edges of said second four edged lateral side plate.

7. The electric guitar with readily attachable and detachable transducer cradles of claim 4 in which each said equivalent single coil transducer cradle component is thinner in width than each of said double coil transducer cradle components and is made up of:

a. a four edged, five hole top plate with a straight front edge, a first lateral edge and a second lateral edge parallel to each other with each said lateral edge perpendicular to said front edge and further a curved posterior edge with a small hook securing hole centered on said top plate's longest midline proximate to said curved posterior edge, a first round grasping hole of diameter in excess of three-eighths of an inch also centered on said top plate's longest midline but less proximate to said curved posterior edge than said small hook securing hole, a first round screw hole for receipt of a transducer mounting screw which said second round screw hole is located centered in said top plate's longest midline anterior to said rectangular hole;

b. a first four edged lateral side plate with top and bottom edges parallel to one another and perpendicular to said side plate's front edge and with a posterior edge inclined with negative slope which said side plate is permanently joined at its top edge to the bottom surface of said four edged, five hole top plate proximate to the said first lateral edge of said four edge, five hole top plate;

c. a second four edged lateral side plate shaped exactly like said first four edged lateral side plate and permanently joined at its top edge to the bottom surface of said four edged, five hole top plate proximate to the said second lateral edge of said four edge, five hole top plate in a positional plane parallel to the positional plane of said first four edged lateral side plate when said side plates are so permanently joined to said four edge, four hole top plate;

d. a first pair of two equivalent metallic contact staple rods each permanently affixed about the front edge of said first four edged lateral side plate and each permanently affixed to the inner and outer surfaces of said first four edged lateral side plate and each with one small hole in the end of each which end is furthest from said front edge and most proximate to said inner surface and such that each of said metallic contact staple rods is separated from the other and so permanently affixed in positional planes parallel to each other and parallel to the top and bottom edges of said first four edged lateral side plate;

e. a second pair of two equivalent metallic contact staple rods each permanently affixed about the front edge of said second four edged lateral side plate and each permanently affixed to the inner and outer surfaces of said second four edged lateral side plate and each with one small hole in the end of each which end is furthest from said front edge and most proximate to said inner surface and such that each one of said metallic contact staple rods is separated from the other and permanently affixed in positional planes parallel to each other and parallel to the top and bottom edges of said second four edged lateral side plate.

8. A method for rapidly and readily frontwise inserting and/or removing an electric guitar double coil transducer directly from an opening in the front of the body of an electric guitar component below the level of intact guitar strings and for coupling said double coil transducer to internal electrical wiring within said electric guitar body and in turn to an amplifier; comprising the steps of: forming an opening in the body of said electric guitar component extending from the front of said body and partially into said body; but not through to the back of said body; and, providing for connection between the wiring of said double coil transducer individually and permanently mounted on a double coil transducer cradle component to the internal electrical wiring within said electric guitar component, by way of contact rods on said double coil transducer cradle component when said double coil transducer cradle component is inserted into said opening which said contact rods are then simultaneously in contact with the wiring of said double coil transducer and contact points in the front wall of said opening that in turn contact said internal electrical wiring.

9. The method of claim 8 in which said opening is appropriately contoured to receive one double coil transducer cradle component with a double coil transducer permanently mounted thereupon.

10. The method of claim 8 in which said opening is appropriately contoured to receive one double coil transducer cradle component with a double coil transducer permanently mounted thereupon but with a clearance therebetween.

11. A method for rapidly and readily frontwise inserting and/or removing electric guitar single coil transducers directly from equivalently dimensioned openings in the front of the body of an electric guitar component below the level of intact guitar strings and for coupling said single coil transducers to internal electrical wiring within said electric guitar body and in turn to an amplifier; comprising the steps of: forming equivalently dimensioned openings in the body of said electric guitar component extending from the front of said body and partially into said body; but not through to the back of said body; and, providing for connection between the wiring of each of said single coil transducers individually and permanently mounted on equivalent single coil transducer cradle components to the internal electrical wiring within said electric guitar component, by way of contact rods on each said single coil transducer cradle component when each said single coil transducer cradle component is inserted into one of said equivalently dimensioned openings which said contact rods are then simultaneously in contact with the wiring of each said single coil transducer and contact points in the front walls of each of said equivalently dimensioned openings that in turn contact said internal electrical wiring.

12. The method of claim 11 in which each of said equivalently dimensioned openings is appropriately contoured to receive one of each said equivalent single coil transducer cradle components each with a single coil transducer permanently mounted thereupon.

13. The method of claim 11 in which each of said equivalently dimensioned openings is appropriately contoured to receive one of each said transducer cradle components each with a one-coil transducer permanently mounted thereupon but with a clearance therebetween.

* * * * *